US009265133B2

(12) United States Patent
Li et al.

(10) Patent No.: US 9,265,133 B2
(45) Date of Patent: Feb. 16, 2016

(54) STATIC ELIMINATION DEVICE AND A CASSETTE

(75) Inventors: Xiande Li, Guandong (CN); Chunhao Wu, Guandong (CN); Kunhsien Lin, Guandong (CN); Erqing Zhu, Guandong (CN); Minghu Qi, Guandong (CN); Weibing Yang, Guandong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 763 days.

(21) Appl. No.: 13/578,621

(22) PCT Filed: Jun. 12, 2012

(86) PCT No.: PCT/CN2012/076771

§ 371 (c)(1), (2), (4) Date: Aug. 11, 2012

(87) PCT Pub. No.: WO2013/177826

PCT Pub. Date: Dec. 5, 2013

(65) Prior Publication Data

US 2013/0321972 A1 Dec. 5, 2013

(30) Foreign Application Priority Data

May 30, 2012 (CN) ..... 2012 1 0174035

(51) Int. Cl.

*H05F 3/00* (2006.01)
*H05F 3/06* (2006.01)
*H01T 19/04* (2006.01)

(52) U.S. Cl.

CPC *H05F 3/00* (2013.01); *H01T 19/04* (2013.01); *H05F 3/06* (2013.01)

(58) Field of Classification Search

USPC ..... 361/213, 22

See application file for complete search history.

(56) References Cited

U.S. PATENT DOCUMENTS 3,793,558 A * 2/1974 Lindsay et al. ..... 361/213
5,140,479 A * 8/1992 Elsing ..... G11B 17/028 360/98.08
5,251,081 A * 10/1993 Cossette ..... G11B 25/043 360/99.08
7,136,271 B2 * 11/2006 Oh et al. ..... 361/221
7,479,615 B2 * 1/2009 Gefter et al. ..... 219/121.36
8,364,588 B2 1/2013 Celka (Continued)

FOREIGN PATENT DOCUMENTS

CN 2826899 Y 10/2006
CN 201994560 U 9/2011

*Primary Examiner* — Thienvu Tran
*Assistant Examiner* — Angela Brooks
(74) *Attorney, Agent, or Firm* — Andrew C. Cheng

(57) ABSTRACT

A static elimination device is proposed for eliminating static electricity on the surface of a large-size glass substrate. The static elimination device includes a rotation axis and an electrostatic neutralizer. The rotation axis is installed outside a cassette in which the glass substrate is installed. The electrostatic neutralizer is permanently connected to the rotation axis. The rotation axis is driven to rotate, causing the electrostatic neutralizer centered on the rotation axis to rotate back and forth at a specific angle. The static elimination device of the present invention features simple structure, low fuel consumption and high efficiency, low cost, and high efficiency in static elimination. Owing to these features, the static elimination device of the present invention could work very well for the glass substrate of an arbitrary size. A cassette including the static elimination device is also proposed.

14 Claims, 4 Drawing Sheets

(56) References Cited

U.S. PATENT DOCUMENTS

2007/0188970 A1* 8/2007 Inaba et al. ..... 361/212
2013/0251493 A1* 9/2013 Zhu et al. ..... 414/788.1
2013/0321972 A1* 12/2013 Li et al. ..... 361/213
2014/0078638 A1* 3/2014 Guo et al. ..... 361/213
2014/0118878 A1* 5/2014 Jiang et al. ..... 361/213
2014/0326686 A1* 11/2014 Li et al. ..... 211/41.1

* cited by examiner

STATIC ELIMINATION DEVICE AND A CASSETTE

BACKGROUND OF THE INVENTION

1. Field of the Invention

The present invention relates to a static elimination technology, and more particularly, to a static elimination device. The present invention also relates to a cassette in which the static elimination device is installed.

2. Description of the Prior Art

A flat-panel device such as art LCD is an essential display device for an electrical product. During the manufacturing, process of a TFT-LCD (short for Thin Film Transistor-Liquid Crystal Display), static electricity is often produced on the surface of a glass substrate when the glass substrate is brought into contact or friction in different processes. Static electricity on the surface of the glass substrate absorbs particles, causing the particles to be attached to the surface of the glass substrate. As a result, the glass substrate is polluted; or even, an electrostatic discharge (ESD) event might occur. Static electricity also causes static charge accumulation. A huge sudden discharge would occur when electric charges are accumulated to a certain degree. A semiconductor element on the glass substrate would be damaged due to the sudden discharge. Moreover, static electricity might be produced when as cassette where the glass substrate is installed is carried or transported.

To settle the damage caused by static electricity, two methods for eliminating static electricity are used in the LCD panel industry. The first one method is that, devices are grounded and the relative humidity of the environment is adjusted so as to eject static electricity from the surface of the object. Or, ions are sprayed on the surface of the glass substrate using an electrostatic neutralizer for eliminating static electricity. The second one method is that, four to six rod-like electrostatic neutralizers installed on the four corners of the outside of the cassette so that every glass substrate layered in the cassette could obtain the sprayed ions from the nozzles of the electrostatic neutralizers. However, the above-mentioned methods have shortcomings:

1. The electrostatic neutralizers are vertically disposed on the four comers of the cassette. The legs of the electrostatic neutralizers may hinder the nozzles of the electrostatic neutralizers from effectively spraying ions on the surface of the glass substrate.

2. The glass substrate is layered inside the cassette. The glass substrate could only obtain scanty ions sprayed by the electrostatic neutralizers, let alone a large-size glass substrate. To effectively eliminate static electricity on the surface of the large-size glass substrate, a plurality of electrostatic neutralizers are used. However, the increasing electrostatic neutralizers are a burden. Production costs increase because of the periodical renewal of the increasing electrostatic neutralizers and the power consumption of the increasing electrostatic neutralizers.

3. The ions sprayed by the electrostatic neutralizers are obviously affected by the airflow inside the dust-free cavity. The airflow inside the dust-free cavity flows in a specific direction, and the specific direction is often contradictory to the path of the sprayed ions. The to contradiction causes the alternation of some paths of the sprayed ions, thereby impeding the electrostatic neutralizers to eliminate static electricity.

SUMMARY OF THE INVENTION

An Object of the present invention is to provide an economical static elimination device which is efficient at eliminating static electricity so that high cost and low efficiency of static elimination in the conventional technology could be solved.

According to the present invention, a static elimination device for eliminating static electricity on a suffice of a large-size glass substrate is proposed. The static elimination device comprises a rotation axis disposed outside a cassette of the glass substrate, and an electrostatic neutralizer, permanently connected to the rotation axis. The rotation axis driven to rotate causes the electrostatic neutralizer centered on the rotation axis to rotate hack and forth at a specific angle.

In one aspect of the present invention, the static elimination device further comprises: a fixation axis, installed at one side of the rotation axis and parallel to the rotation axis; a telescopic device, comprising two terminals, the one terminal permanently connected to the fixation axis, the other terminal rotatably connected to the rotation axis, and a horizontal direction between the fixation axis and the rotation axis parallel to a direction along the telescopic device; a short lever, comprising two terminals, the one terminal permanently connected to the rotation axis, and the other terminal permanently connected to the electrostatic neutralizer.

In another aspect of the present invention, the telescopic device is a cylinder.

In another aspect of the present invention, the electrostatic neutralizer centered on the rotation axis rotates at an angle of 0 to 90 degrees.

In another aspect of the present invention, the electrostatic neutralizer comprises a rod and a plurality of emitter sets, the rod is a high-pressure gas-filled rod, and the plurality of emitter sets are vertically disposed on the rod at intervals.

In another aspect of the present invention, the plurality of emitter sets comprise: an emitter, disposed on the rod vertically, comprising a tip which keeps discharging for producing was used for neutralizing static electricity on the surface of the glass substrate; a nozzle, installed at a periphery of the emitter, the nozzle comprising an aperture, and the aperture of the nozzle and the tip of the emitter facing the same direction; the nozzle connected to a body of the rod, and the high-pressure gas which passes through the body of the rod spraying the ions produced by the emitter on the surface of the glass substrate at a specific angle through the nozzle.

In another aspect of the present invention, the nozzle is a cone-shaped nozzle, and a spraying angle on an extension view is usually set as 35 degrees.

In another aspect of the present invention, the static elimination device further comprises a server drive motor, and the server drive motor is connected to the rotation axis and drives the rotation axis to rotate at a specific angle.

In another aspect of the present invention, the static elimination device are two in quantity, the two static elimination devices are symmetrically disposed on the diagonal corners of the cassette and outside the cassette, and the two static elimination devices are perpendicular to a bottom of the cassette.

According to the present invention, a cassette comprises an entity of cassette and a static elimination device installed on the entity of cassette. The static elimination device comprises a rotation axis, disposed outside the entity of cassette in which a glass substrate is installed; an electrostatic neutralizer, permanently connected to the rotation axis; a fixation axis, installed at one side of the rotation axis and parallel to the rotation axis; as telescopic device, comprising two terminals, the one terminal permanently connected to the fixation axis, the other terminal rotatably connected to the rotation axis, and a horizontal direction between the fixation axis and the rotation axis parallel to a direction along, the telescopic device; a short lever, comprising two terminals, the one terminal permanently connected to the rotation axis, and the other terminal permanently connected to the electrostatic neutralizer; the rotation axis driven to rotate, causing the electrostatic neutralizer centered on the rotation axis to rotate hack and forth at a specific angle.

In one aspect of the present invention, the electrostatic neutralizer centered on the rotation axis rotates back and forth at an angle of 0 to 90 degrees.

In another aspect of the present invention, the electrostatic neutralizer comprises a rod and a plurality of emitter sets, the rod is a high-pressure gas-filled rod, and the plurality of emitter sets are vertically disposed on the rod at intervals.

In another aspect of the present invention, the plurality of emitter sets comprise: an emitter, disposed on the rod vertically, comprising a tip which keeps discharging for producing ions used for neutralizing static electricity on a surface of the glass substrate; a nozzle, installed at a periphery of the emitter; the nozzle comprising an aperture, and the aperture of the nozzle and the tip of the emitter facing the same direction; the nozzle connected to a body of the rod, and the high-pressure gas which passes through the body of the rod spraying the ions produced by the emitter on the surface of the glass substrate at a specific angle through the nozzle.

In another aspect of the present invention, the electrostatic neutralizer further comprises a server drive motor, and the server drive motor is connected to the rotation axis and drives the rotation axis to rotate at a specific angle.

In another aspect of the present invention, the static elimination device are two in quantity, the two static elimination devices are symmetrically disposed on the diagonal corners of the entity or cassette and outside the entity of cassette, and the two static elimination devices are perpendicular to a bottom of the entity of cassette.

Compared with the conventional technology, the electrostatic neutralizer in the static elimination device in the present invention is disposed on the diagonal corner of the cassette and outside the cassette. The electrostatic neutralizer centered on the rotation axis rotates back and forth at a specific angle and sprays ions on the surface of the glass substrate inside the cassette. In this way, static electricity is completely eliminated on the surface of the glass substrate. The static elimination device of the present invention features simple structure, low fuel consumption and high efficiency, low cost, and high efficiency in static elimination. So the static elimination device of the present invention could work very well for the glass substrate of an arbitrary size.

BRIEF DESCRIPTION OF THE DRAWINGS

These and other features, aspects and advantages of the present disclosure will become understood with reference to the following description, appended claims and accompanying figures.

DETAILED DESCRIPTION OF THE PREFERRED EMBODIMENTS

Figure 1:
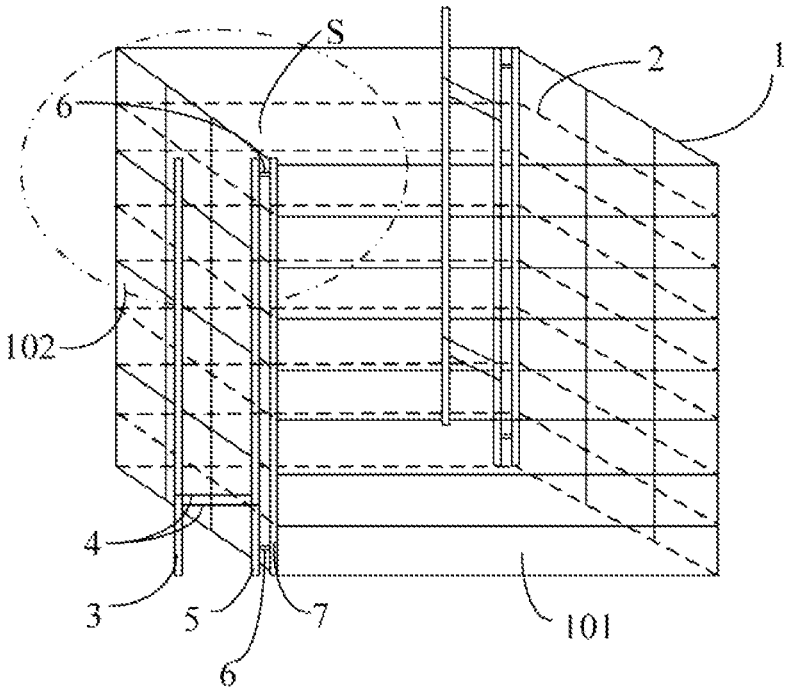
FIG. 1 shows a schematic diagram of a static elimination device according to a first embodiment of the present invention.

Hereinafter, exemplary embodiments of the present invention will be described with reference to the accompanying drawings. In the following description, the same elements will be designated by the same reference numerals although they are shown in different drawings. Further, in the following description of the present invention, a detailed description of known functions and configurations incorporated herein will be omitted when it may make the subject matter of the present invention rather unclear.

A First Embodiment

Referring to FIG. 1, FIG. 1 shows a schematic diagram of a static elimination device according to a first embodiment of the present invention. The static elimination device is used for eliminating static electricity on the surface of a large-size glass substrate. The static elimination device used in this embodiment is two in quantity. The two static elimination devices are installed outside of a cassette 1 which comprises a glass substrate 2. The two static elimination devices are symmetrically installed on diagonal corners of the cassette 1. The static elimination devices are perpendicular to the bottom or the cassette 1. The static elimination device comprises a fixation axis 3, a telescopic device 4, a rotation axis 5, a short lever 6, and an electrostatic neutralizer 7.

The rotation axis 5 is installed outside the cassette 1. The fixation axis 3 is installed at one side of the rotation axis 5 and is parallel to the rotation axis 5. The telescopic device 4 comprises two terminals. One terminal is permanently connected to the fixation axis 3 and the other terminal is rotatably connected to the rotation axis 5. The horizontal direction between the fixation axis 3 and the rotation axis 5 is parallel to the direction along the telescopic device 4. The short lever 6 comprises a terminal permanently connected to the rotation axis 5 and the other terminal permanently connected to the electrostatic neutralizer 7. The static elimination device further comprises a server drive motor (not shown in FIG. 1). The server drive motor is connected to the rotation axis 5. The rotation axis 5 rotates at a specific angle. The rotation axis 5 is driven to rotate, and simultaneously, the electrostatic neutralizer 7 is rotated by the rotation axis 5 via the short lever 6. To make sure that transferring power of the rotation axis 5 could be transferred to the electrostatic neutralizer 7, two short levers 6 are used in this embodiment. The short levers 6 are in parallel.

Figure 2:
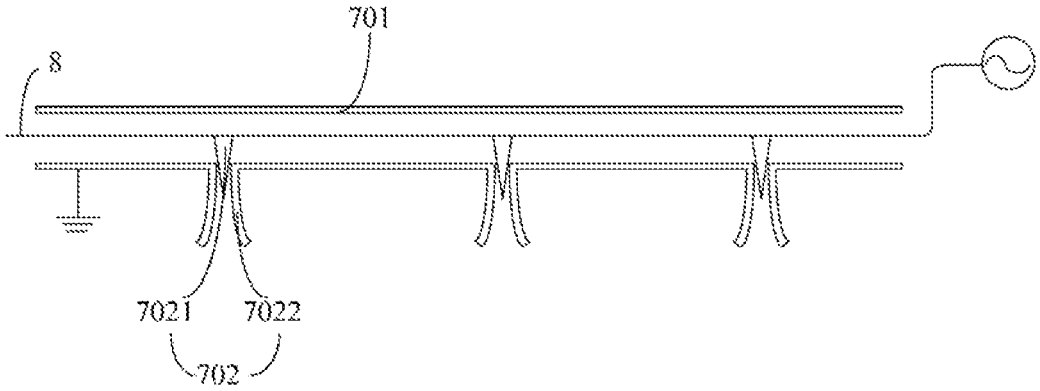
FIG. 2 shows a schematic diagram of the electrostatic neutralizer.

Referring to FIG. 2, FIG. 2 shows as schematic diagram of the electrostatic neutralizer 7. The electrostatic neutralizer 7 comprises a rod 701 and a plurality of emitter sets 702. The rod 701 is a high-pressure gas-filled rod. A power cord 8 bringing alternating current (AC) penetrates the rod 701. The plurality of emitter sets 702 are vertically disposed on the rod 701 at intervals. The distance between every two emitter sets 702 is set as 5 cm to 10 cm.

Specifically, each of the plurality of emitter sets 702 comprises an emitter 7021 and a nozzle 7022. The emitter 7021 is electrically connected to the power cord 8 and is disposed on the rod 701 vertically. The tip of the emitter 7021 keeps discharging for producing ions. The ions are used for neutralizing static electricity on the surface of the glass substrate 2. The electricity of the ions is mutually changed when the electricity of the AC varies. The nozzle 7022 is installed at the periphery of the emitter 7021. The aperture of the nozzle 7022 and the tip of the emitter 7021 face the same direction. The nozzle 7022 is connected to the body of the rod 701. The high-pressure gas in the body of the rod 701 sprays the ions produced by the emitter 7021 on the surface of the glass substrate 2 at a specific angle through the nozzle 7022. The nozzle 7022 is a cone-shaped nozzle. The spraying angle on the extension view is usually set as 35 degrees. The angle could also be 30 or 40 degrees or other suitable degrees.

Figure 3:
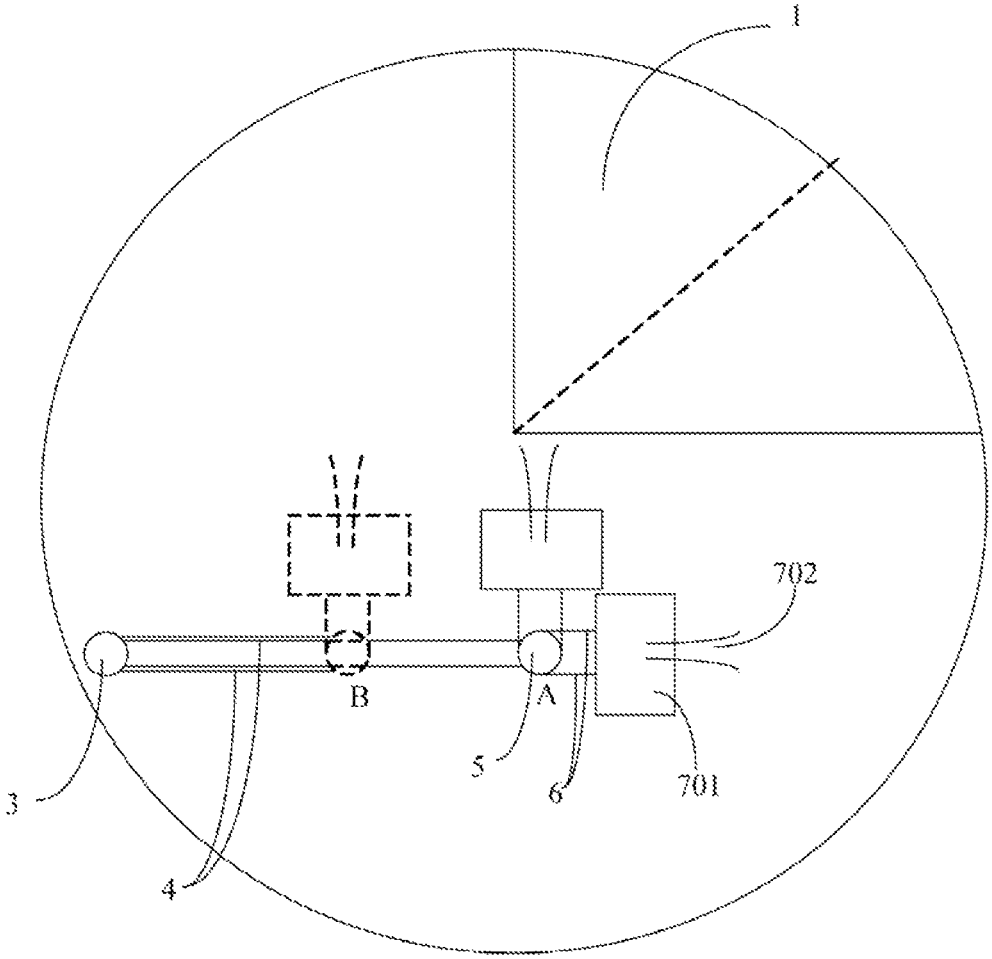
FIG. 3 shows an enlarged diagram of a labeled region S' in FIG. 1.

Referring to FIGS. 1 to 3, the plurality of emitter sets 702 of the electrostatic neutralizer 7 are disposed on the rod 701 vertically. The plurality of emitter sets 702 spray the ions on the glass substrate 2 placed at different height in the cassette 1 for neutralizing static electricity on the surface of the glass substrate 2. The rotation axis 5 is driven to rotate by the server drive motor. Simultaneously, the electrostatic neutralizer 7 centered on the rotation axis 5 is driven to rotate back and forth via the short levers 6 at a specific angle. The electrostatic neutralizer 7 centered on the rotation axis 5 rotates at the angle of 0 to 90 degrees. Preferably, the angle is 90 degrees in this embodiment. As shown in FIG. 2, the electrostatic neutralizer 7 sprays the ions from a frontal surface 101 of the cassette 1 to a lateral side 102 of the cassette 1. While the electrostatic neutralizer 7 sprays the ions, the nozzle 7022 of the electrostatic neutralizer 7 moves its position. The nozzle 7022 of the electrostatic neutralizer 7 swings back and forth on the surface of the glass substrate 2. So the ions could be sprayed widely on the surface of the glass substrate 2. In other words, static electricity on the surface of the glass substrate 2 could be eliminated to a large scale. It implies that static electricity on the surface of any large-size glass substrate 2 could be eliminated with one or two electrostatic neutralizer(s) 7 since the ions could be sprayed on a larger area using the electrostatic neutralizer 7. Moreover, the electrostatic neutralizer 7 is movable, avoiding the sprayed ions from being hindered by the frame of the cassette 1. The sprayed ions could effectively touch the glass substrate 2, which enhances the efficiency of static elimination.

The telescopic device 4 is a cylinder in this embodiment. The telescopic device 4 is placed between the fixation axis 3 and the rotation axis 5. In the static elimination device, the telescopic device 4 could control the electrostatic neutralizer 7 to be moved from Point A to Point B to keeping away from the cassette 1 and the glass substrate 2 when the cassette 1 and the glass substrate 2 are retrieved. Thus, the cassette 1 and the glass substrate 2 could be arbitrarily retrieved without being damaged. In a practical application, the telescopic device 4 might have other structures. The structure of telescopic device 4 could be a similar structure having the same functions.

The rotation axis 5 could be driven by a drive device which has the same functions as the server drive motor used in this embodiment does. The short levers 6 in the present invention could be disposed parallelly with each other or could not be disposed parallelly. The short lever 6 could be one or more in quantity. The static elimination device in the present invention is not limited to two in quantity; instead, it is possible to use one or more static elimination devices.

In conclusion, it will be readily apparent to those skilled in the art that the electrostatic neutralizer centered on the rotation axis rotates back and forth at a specific angle and sprays the ions on the surface of the glass substrate inside the cassette. Accordingly, static electricity is completely eliminated on the surface of the glass substrate. The electrostatic neutralizer sprays the ions in an undetermined direction, which prevents the path of the sprayed ions from being disturbed by the airflow inside the dust-free cavity. Thus, static electricity on the surface of the glass substrate could be effectively eliminated. As mentioned above, the conventional static elimination device where a plurality of electrostatic neutralizers need to be installed has low efficiency. However, the static elimination device of the present invention features simple structure, low fuel consumption and high efficiency, low cost, and high efficiency in static elimination. Owing to these features, the static elimination device of the present invention could work very well for the glass substrate of an arbitrary size. Meanwhile, the static elimination device of the present invention also comprises the telescopic device. When the cassette and the glass substrate are retrieved by the telescopic device, the electrostatic neutralizer is contracted by the telescopic device at the same time. The electrostatic neutralizer is always away from the cassette and the glass substrate, which makes it easy to retrieve the cassette and the glass substrate and makes sure the safety of retrieval of the cassette and the glass substrate.

A Second Embodiment

Figure 4:
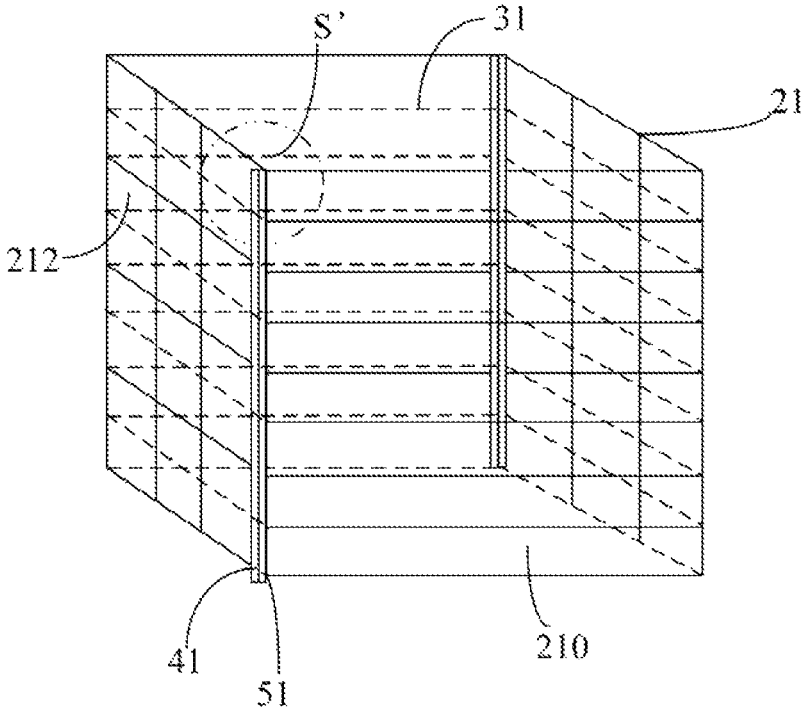
FIG. 4 shows a schematic diagram of a static elimination device according to a second embodiment of the present invention.

Referring to FIG. 4, FIG. 4 shows a schematic diagram of a static elimination device according to a second embodiment of the present invention. The static elimination device is used for eliminating static electricity on the surface of a large-size glass substrate. Differing from the static elimination device which comprises a fixation axis, a telescopic device, and two short levers in the first embodiment, the static elimination device does not comprise any fixation axis, telescopic device, or short lever in this embodiment.

Two static elimination devices are used in this embodiment. The two static elimination devices are installed outside of a cassette 21 in which a glass substrate 31 is installed. The two static elimination devices are installed on diagonal corners of the cassette 21 symmetrically. The static elimination devices are perpendicular to the bottom of the cassette 21. Each of the static elimination devices comprises a rotation axis 41 and an electrostatic neutralizer 51. The rotation axis 41 is disposed outside the cassette 21 where the glass substrate 31 is installed. The electrostatic. neutralizer 51 is permanently connected to the rotation axis 41 with a rivet or a bolt. Each of the static elimination devices further comprises a server drive motor (not shown in FIG. 4). The server drive motor is connected to the rotation axis 41. The rotation axis 41 is driven to rotate at a specific angle. The electrostatic neutralizer 51 centered on the rotation axis 41 rotates at the angle of 0 to 90 degrees. Preferably, the angle is 90 degrees in this embodiment.

Figure 5:
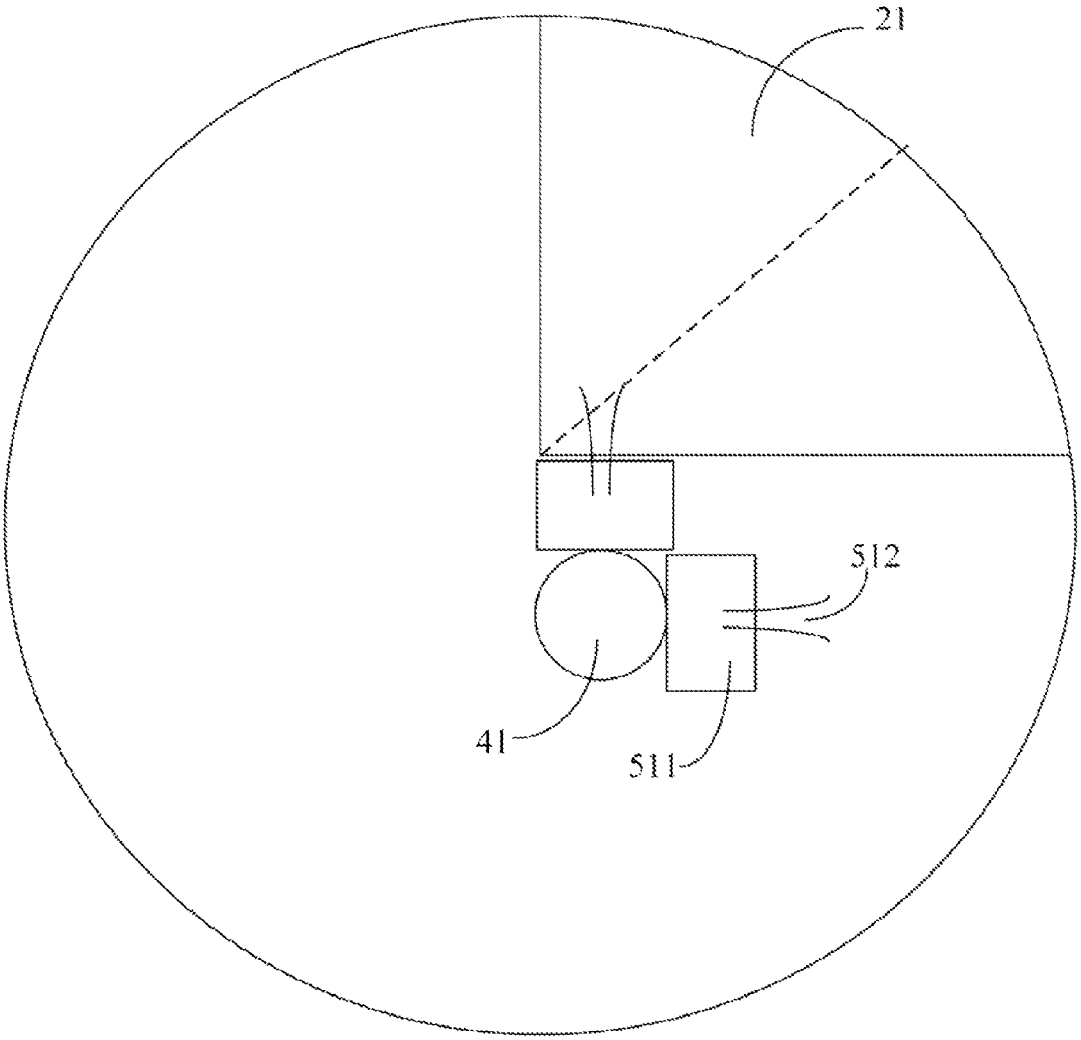
FIG. 5 shows an enlarged diagram of a labeled region S' in FIG. 4.

Referring to FIG. 5, FIG. 5 shows a schematic diagram of the electrostatic neutralizer 51. The electrostatic neutralizer 51 comprises a rod 511 and a plurality of emitter sets 512. The rod 511 is a high-pressure gas-filled rod. A power cord bringing alternating current (AC) penetrates the rod 511. The plurality of emitter sets 512 are vertically disposed on the rod 511 at intervals. The distance between every two emitter sets 512 is, set as 5 cm to 10 cm.

The electrostatic neutralizer 51 used in this embodiment is the one used in the first embodiment, so the detailed description of the structure and working principle of the electrostatic neutralizer 51 will not herein be repeated.

Referring to FIGS. 4 and 5, the plurality of emitter sets 512 of the electrostatic neutralizer 51 are disposed on the rod 511 vertically. The plurality of emitter sets 512 spray ions on the glass substrate 31 placed at different height in the cassette 21 for neutralizing static electricity on the surface of the glass substrate 31. The rotation axis 41 is driven to rotate by the server drive motor. Simultaneously, the electrostatic neutralizer 51 centered on the rotation axis 41 rotates back and forth at a specific angle. The electrostatic neutralizer 51 centered on the rotation axis 41 rotates at the angle of 0 to 90 degrees. Preferably, the angle is 90 degrees in this embodiment. As shown in FIG. 4, the electrostatic, neutralizer 51 sprays the ions from a frontal surface of the cassette 21 to a lateral side of the cassette 21. While spraying the ions, the electrostatic neutralizer 51 moves its position. The electrostatic neutralizer 51 swings back and forth on the surface of the glass substrate 31. Thus, the ions could be sprayed widely on the glass substrate 31. In other words, static electricity on the surface of the glass substrate 31 could be eliminated to a large scale. Static electricity on the surface of any large-size glass to substrate 31 could be eliminated only using one or two electrostatic neutralizer(s) 51 since the ions could be sprayed on a larger area using the electrostatic neutralizer 51. Moreover, the electrostatic neutralizer 51 is movable, avoiding the sprayed ions from being hindered by the frame of the cassette 21. The sprayed ions could effectively touch the glass substrate 31, which enhances the efficiency of static elimination.

The rotation axis 41 could be driven by a drive device which has the same functions as the server drive motor used in this embodiment does. The number of the static elimination device in the present invention is not limited to two; instead, it is possible to use one or more than two static elimination device(s).

In conclusion, it will be readily apparent to those skilled in the art that the electrostatic neutralizer centered on the rotation axis rotates hack and forth at a specific angle and sprays the ions on the surface of the glass substrate installed in the cassette. Accordingly, static electricity is completely eliminated on the surface of the glass substrate. The electrostatic neutralizer sprays the ions in an undetermined direction, which prevents the path of the sprayed ions from being disturbed by the airflow inside the dust-free cavity. Thus, static electricity on the surface of the glass substrate could be effectively eliminated. As mentioned above, the conventional static elimination device where a plurality of electrostatic neutralizers need to be installed has low efficiency. However, the static elimination device of the present invention features simple structure, low fuel consumption and high efficiency, low cost, and high efficiency in static elimination. Owing to these features, the static elimination device of the present invention could work very well for the glass substrate of an arbitrary size.

In addition, another cassette is provided. The cassette comprises the above-mentioned static elimination device for eliminating static electricity on the surface of the glass substrate installed in the cassette.

While the present invention has been described in connection with what is considered the most practical and preferred embodiments, it is understood that this invention is not limited to the disclosed embodiments but is intended to cover various arrangements made without departing from the scope of the broadest interpretation of the appended claims.

What is claimed is:

1. A static elimination device, for eliminating static electricity on a surface of a large-size glass substrate, comprising:

a rotation axis, disposed outside a cassette of the glass substrate;

an electrostatic neutralizer, permanently connected to the rotation axis;

the rotation axis driven to rotate, causing the electrostatic neutralizer centered on the rotation axis to rotate back and forth at a specific angle;

a fixation axis, installed at one side of the rotation axis and parallel to the rotation axis;

a telescopic device, comprising two terminals, the one terminal permanently connected to the fixation axis, the other terminal rotatably connected to the rotation axis, and a horizontal direction between the fixation axis and the rotation axis parallel to a direction along the telescopic device; and a short lever, comprising two terminals, the one terminal permanently connected to the rotation axis, and the other terminal permanently connected to the electrostatic neutralizer.

2. The static elimination device as claimed in claim 1, wherein the telescopic device is a cylinder.

3. The static elimination device as claimed in claim 1, wherein the electrostatic neutralizer centered on the rotation axis rotates at an angle of 0 to 90 degrees.

4. The static elimination device as claimed in claim 1, wherein the electrostatic neutralizer comprises a rod and a plurality of emitter sets, the rod is a high-pressure gas-filled rod, and the plurality of emitter sets are vertically disposed on the rod at intervals.

5. The static elimination device as claimed in claim 4, wherein the plurality of emitter sets comprise:

an emitter, disposed on the rod vertically, comprising a tip which keeps discharging for producing ions used for neutralizing static electricity on the surface of the glass substrate;

a nozzle, installed at a periphery of the emitter, the nozzle comprising an aperture, and the aperture of the nozzle and the tip of the emitter facing the same direction;

the nozzle connected to a body of the rod, and the high-pressure gas which passes through the body of the rod spraying the ions produced by the emitter on the surface of the glass substrate at a specific angle through the nozzle.

6. The static elimination device as claimed in claim 5, wherein the nozzle is a cone-shaped nozzle, and a spraying angle on an extension view is usually set as 35 degrees.

7. The static elimination device as claimed in claim 1, wherein the static elimination device further comprises a server drive motor, and the server drive motor is connected to the rotation axis and drives the rotation axis to rotate at a specific angle.

8. The static elimination device as claimed in claim 1, wherein the static elimination device are two in quantity, the two static elimination devices are symmetrically disposed on the diagonal corners of the cassette and outside the cassette, and the two static elimination devices are perpendicular to a bottom of the cassette.

9. A cassette, comprising an entity of cassette and a static elimination device installed on the entity of cassette, wherein the static elimination device comprises:

a rotation axis, disposed outside the entity of cassette in which a glass substrate is installed;

an electrostatic neutralizer, permanently connected to the rotation axis;

a fixation axis, installed at one side of the rotation axis and parallel to the rotation axis;

a telescopic device, comprising two terminals, the one terminal permanently connected to the fixation axis, the other terminal rotatably connected to the rotation axis, and a horizontal direction between the fixation axis and the rotation axis parallel to a direction along the telescopic device;

a short lever, comprising two terminals, the one terminal permanently connected to the rotation axis, and the other terminal permanently connected to the electrostatic neutralizer;

the rotation axis driven to rotate, causing the electrostatic neutralizer centered on the rotation axis to rotate back and forth at a specific angle.

10. The cassette as claimed in claim 9, wherein the electrostatic neutralizer centered on the rotation axis rotates back and forth at an angle of 0 to 90 degrees.

11. The cassette as claimed in claim 9, wherein the electrostatic neutralizer comprises a rod and a plurality of emitter sets, the rod is a high-pressure gas-filled rod, and the plurality of emitter sets are vertically disposed on the rod at intervals.

12. The cassette as claimed in claim 11, wherein the plurality of emitter sets comprise:

an emitter, disposed on the rod vertically, comprising a tip which keeps discharging for producing ions used for neutralizing static electricity on a surface of the glass substrate;

a nozzle, installed at a periphery of the emitter, the nozzle comprising an aperture, and the aperture of the nozzle and the tip of the emitter facing the same direction;

the nozzle connected to a body of the rod, and the high-pressure gas which passes through the body of the rod spraying the ions produced by the emitter on the surface of the glass substrate at a specific angle through the nozzle.

13. The cassette as claimed in claim 9, wherein the electrostatic neutralizer further comprises a server drive motor, and the server drive motor is connected to the rotation axis and drives the rotation axis to rotate at a specific angle.

14. The cassette as claimed in claim 9, wherein the static elimination device are two in quantity, the two static elimination devices are symmetrically disposed on the diagonal corners of the entity of cassette and outside the entity of cassette, and the two static elimination devices are perpendicular to a bottom of the entity of cassette.

* * * * *